US010611450B2

(12) United States Patent
Zenoz

(10) Patent No.: US 10,611,450 B2
(45) Date of Patent: Apr. 7, 2020

(54) HYBRID WING RIGGING FOR WIND-PROPELLED VESSEL

(71) Applicant: Fast Forward Composites Corp., Bristol, RI (US)

(72) Inventor: Tomas Fernando Gonzalez Zenoz, Miami, FL (US)

(73) Assignee: Fast Forward Composites Corp., Bristol, RI (US)

( * ) Notice: Subject to any disclaimer, the term of this patent is extended or adjusted under 35 U.S.C. 154(b) by 0 days.

(21) Appl. No.: 15/877,711

(22) Filed: Jan. 23, 2018

(65) Prior Publication Data

US 2018/0208287 A1 Jul. 26, 2018

Related U.S. Application Data

(60) Provisional application No. 62/449,188, filed on Jan. 23, 2017.

(51) Int. Cl.

| | |
|---|---|
| ***B63B 9/06*** | (2006.01) |
| ***B63H 9/10*** | (2006.01) |
| ***B63H 9/06*** | (2020.01) |
| ***B63H 9/08*** | (2006.01) |
| *B63B 15/02* | (2006.01) |
| *B63B 15/00* | (2006.01) |

(52) U.S. Cl.

CPC ..... *B63H 9/10* (2013.01); *B63H 9/0607* (2013.01); *B63H 9/08* (2013.01); *B63B 15/0083* (2013.01); *B63B 15/02* (2013.01); *B63B 2015/005* (2013.01); *B63H 2009/0621* (2013.01); *B63H 2009/086* (2013.01)

(58) Field of Classification Search

CPC ..... B63H 9/0607; B63H 9/0614; B63H 2009/0621; B63H 2009/0628; B63H 2009/0635; B63B 15/0083; B63B 2015/0091; B63B 15/02

See application file for complete search history.

(56) References Cited

U.S. PATENT DOCUMENTS 4,230,060 A * 10/1980 McCoy ..... B63B 15/02 114/102.29

6,116,177 A * 9/2000 Conant ..... B63B 15/0083 114/102.16

* cited by examiner

*Primary Examiner* — Andrew Polay

(74) *Attorney, Agent, or Firm* — Mintz Levin Cohn Ferris Glovsky and Popeo, P.C.; Steven M. Jensen

(57) ABSTRACT

A rigging for a wind-propelled vessel includes: a rotating airfoil-shaped mast; a sail movably coupled to a trailing edge of the airfoil-shaped mast and configured to be hoisted or lowered along the airfoil-shaped mast; a swiveling masthead coupled to a top section of the airfoil-shaped mast; and a plurality of stays supporting the airfoil-shaped mast, each stay having a first end connected to the swiveling masthead and a second end connected to a hull of the vessel.

38 Claims, 10 Drawing Sheets

HYBRID WING RIGGING FOR WIND-PROPELLED VESSEL

CROSS-REFERENCE TO RELATED APPLICATION

This application claims the benefit of priority to U.S. Provisional Patent Application No. 62/449,188, filed in the United States Patent and Trademark Office on Jan. 23, 2017, the entire contents of which are incorporated herein by reference.

TECHNICAL FIELD

The present disclosure relates generally to sailing vessels, and more particularly, to a rigging for a wind-propelled vessel.

BACKGROUND

Wind-propelled vessels, such as sail boats, yachts, catamarans, and the like, are generally driven either partly or entirely by sails. For example, FIG. 1 illustrates a conventional mono-hull vessel 100 including a curved, triangular fabric sail 110, which at different points thereof takes a different angle to the vessel 100. The sail 110 is able to convert wind energy into motion of the vessel 100 by redirecting the power of the wind to propel the vessel 100 along water. The sail 110 is typically held up by a mast 120 extending vertically from the vessel 100 to provide support for the sail 110 as it drives the vessel 100. A horizontal pole known as a boom 130 extends along the length of the base of the sail 110 to improve control of the angle and shape of the sail 110.

Meanwhile, the mast 120 is held up in both the sideways and fore and aft directions by a system of stays 140. The stays 140 are typically ropes, wires, or rods running from the mast 120 to the hull that serve to stabilize the mast 120. The type, number, and attachment points of the stays 140 may vary greatly according to the design of the vessel. One common characteristic among all stay systems, however, is that the stays 140 limit the possible angles of the horizontal boom 130. The limitation is caused by the stays 140 being positioned so as to interrupt the rotational range of the boom 130. Thus, there are a limited number of angles to which the sail 110 can be rotated.

FIG. 2 illustrates a conventional multi-hull vessel 200 including a similar triangular sail 210 coupled to a mast 220 and horizontal boom 230. Here, the staying system 240 produces a tripod-like array where three stays support the mast 220—two in the side direction and one in the forward direction. The side stays are attached to the hulls in the aft direction at roughly 60 degrees to the vessel's centerline to provide aft-ward support to the mast 220. In general, the multi-hull staying system 240 is a relatively efficient system compared to the narrower mono-hull vessel 100 in FIG. 1 since the stays are positioned further from the centerline, resulting in a less narrow angle to the mast 220 which decreases the load to support the mast 220. The drawback with this system, however, is that the aft-ward direction of the stays 240 limits the angle of boom 230, which in turn limits the vessel's point of sail range.

Much attention has been paid in recent years to wing-like contrivances that replace the mast-boom-sail combination shown in FIGS. 1 and 2 at a great gain in performance. In this regard, FIG. 3 illustrates a multi-hull vessel 300 including a wing sail 310, in place of a traditional sail, extending substantially vertically much like a mast and with a system of stays 340 attached directly thereto. The wing sail 310 is an airfoil-shaped aerodynamic structure fixed to the vessel 300 that is designed to provide lift on either side of the wing to accommodate being on either tack, similar to an airplane wing. Conventionally, the wing sail 310 is relatively rigid with a two- or three-stage control flap system which adds considerably to a vessel's performance, mainly in multi-hull yachts. But rigid wings, except at such advanced levels of sailing as the America's Cup, are very impractical in every day sailing. Because they are extremely powerful, expert handling of the vessel 300 and wing sail 310 is required. Additionally, the conventional wing sail 310 cannot be reefed (i.e., made smaller) when the wind increases, it cannot be easily hoisted or lowered, except with a dock or barge-mounted crane, and it cannot be left up at moorings or when docked as changes in wind strength and direction can exert high sailing loads on the vessel 300, putting strain on the vessel and potentially causing the vessel to capsize.

SUMMARY OF THE DISCLOSURE

The present disclosure provides a hybrid wing for a wind-propelled vessel that addresses many practical challenges of conventional fixed, rigid wing sails. Particularly, the hybrid wing disclosed herein includes an airfoil-shaped mast and a sail movably coupled to a trailing edge of the airfoil-shaped mast. The sail can be readily hoisted or lowered along the airfoil-shaped mast. In addition, a swiveling masthead coupled to a top section of the airfoil-shaped mast enables a system of stays to extend from the masthead to the vessel body such that the stays are positioned outside of a rotational range of the airfoil-shaped mast. The result is that the system of stays does not restrict the rotation of the airfoil-shaped mast, allowing the airfoil-shaped mast to align to any wind direction when the sail is lowered, e.g., when anchored or docked, which eliminates wind-induced heeling or thrust of the vessel typical of fixed, rigid wing sails.

According to embodiments of the present disclosure, a rigging for a wind-propelled vessel includes: a rotating airfoil-shaped mast; a sail movably coupled to a trailing edge of the airfoil-shaped mast and configured to be hoisted or lowered along the airfoil-shaped mast; a swiveling masthead coupled to a top section of the airfoil-shaped mast; and a plurality of stays supporting the airfoil-shaped mast, each stay having a first end connected to the swiveling masthead and a second end connected to a hull of the vessel.

The plurality of stays may be positioned outside of a rotational range of the airfoil-shaped mast, such that the airfoil-shaped mast is configured to rotate independent of and without interference with the plurality of stays. The rotational range of the airfoil-shaped mast can therefore be 360 degrees when the sail is lowered. Also, the airfoil-shaped mast can automatically align itself in accordance with a wind force exerted on the rigging when the sail is lowered.

The rigging may further include a track affixed to the trailing edge of the airfoil-shaped mast on which the sail slides upwardly and downwardly. The rigging may even further include a plurality of sliding members attached to the sail and configured to communicate with the track so as to allow the sail to slide upwardly and downwardly on the track.

The rigging may further include one or more rolling members positioned above the sail and configured to accept a halyard which runs along the one or more rolling members for hoisting or lowering the sail along the airfoil-shaped mast. The rigging may even further include a locking member through which the halyard runs, the locking member configured to lock the halyard so as to hold the sail in place.

The swiveling masthead may include a center portion and a plurality of arms extending outwardly from the center portion, and the first end of each of the plurality of stays is connected to one of the plurality of arms. The swiveling masthead may be positioned substantially above the airfoil-shaped mast and may be configured to rotate independent of the airfoil-shaped mast. The swiveling masthead may also be configured to rotate about a longitudinal axis of the airfoil-shaped mast. Furthermore, the swiveling masthead may be equipped with one or more axial bearings to facilitate rotation of the swiveling masthead about the longitudinal axis of the airfoil-shaped mast, and may be equipped with one or more thrust bearings to sustain a downward load effected by a wind force exerted on the rigging.

The plurality of stays may include one forward stay and two aft stays or two forward stays and two aft stays. In addition, the rigging may lack a forward sail and/or a horizontal boom.

The vessel may be a mono-hull or multi-hull vessel. If the vessel is a mono-hull vessel, the second end of one or more of the plurality of stays may be connected to one or more sprits extending outwardly from the mono-hull vessel.

BRIEF DESCRIPTION OF THE DRAWINGS

The embodiments herein may be better understood by referring to the following description in conjunction with the accompanying drawings in which like reference numerals indicate identically or functionally similar elements, of which.

Figure 1:
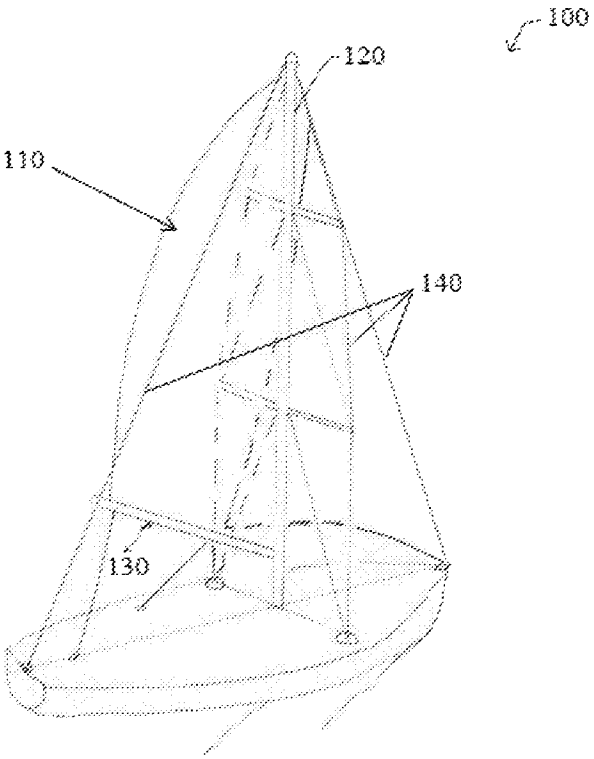
FIG. 1 RELATED ART
FIG. 1 illustrates a conventional mono-hull vessel including a curved, triangular sail.
Figure 2:
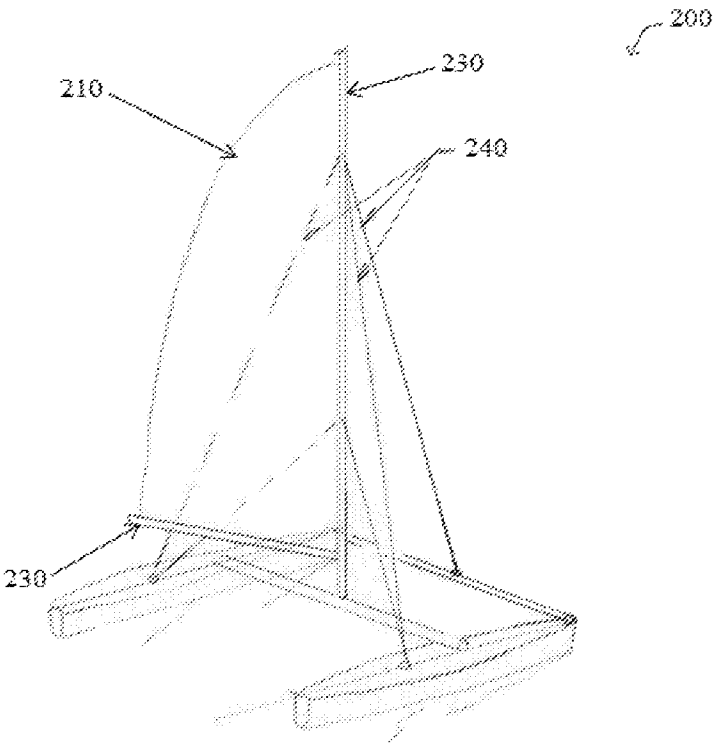
FIG. 2 RELATED ART
FIG. 2 illustrates a conventional multi-hull vessel including a curved, triangular sail.
Figure 3:
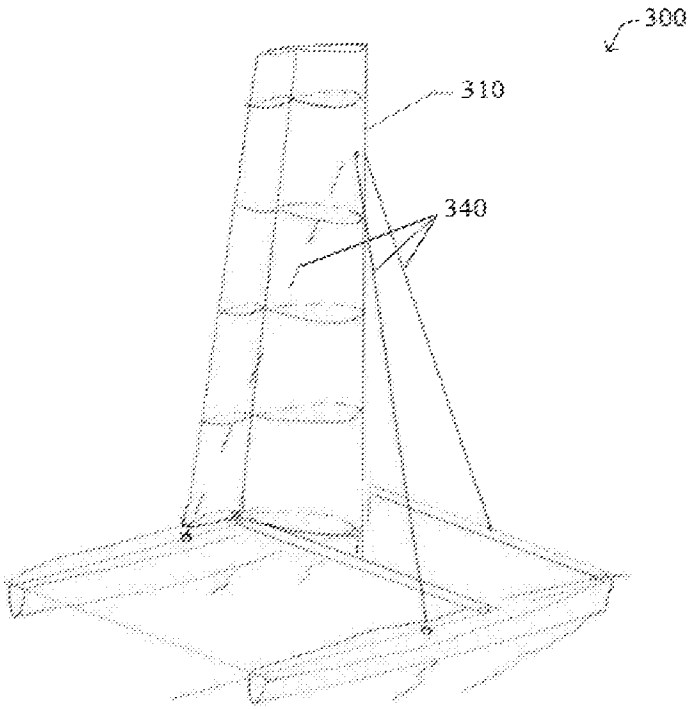
FIG. 3 RELATED ART
FIG. 3 illustrates a multi-hull vessel including a conventional wing sail.

It should be understood that the above-referenced drawings are not necessarily to scale, presenting a somewhat simplified representation of various preferred features illustrative of the basic principles of the disclosure. The specific design features of the present disclosure, including, for example, specific dimensions, orientations, locations, and shapes, will be determined in part by the particular intended application and use environment.

DETAILED DESCRIPTION OF THE EMBODIMENTS

Hereinafter, embodiments of the present disclosure will be described in detail with reference to the accompanying drawings. As those skilled in the art would realize, the described embodiments may be modified in various different ways, all without departing from the spirit or scope of the present disclosure. Further, throughout the specification, like reference numerals refer to like elements.

The terminology used herein is for the purpose of describing particular embodiments only and is not intended to be limiting of the disclosure. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

Referring now to embodiments of the present disclosure, the disclosed hybrid wing for a wind-propelled vessel includes an airfoil-shaped mast extending vertically from the vessel and a sail movably coupled to a trailing edge of the airfoil-shaped mast. The sail can be readily hoisted or lowered along the airfoil-shaped mast. A system of stays is connected to a swiveling masthead coupled to a top section of the airfoil-shaped mast. The masthead which is positioned above the airfoil-shaped mast enables the system of stays to be positioned outside of a rotational range of the airfoil-shaped mast. As a result, the system of stays do not restrict the rotation of the airfoil-shaped mast, allowing the airfoil-shaped mast to align to any wind direction when the sail is lowered. This eliminates wind-induced heeling or thrust of the vessel when anchored or docked that is common among fixed, rigid wing sails.

Figure 4:
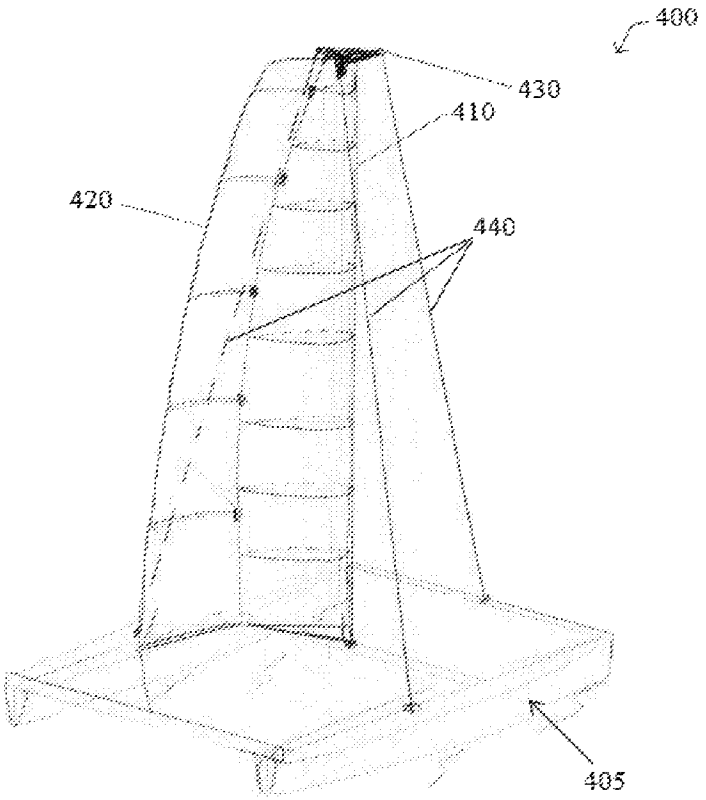
FIG. 4 illustrates an exemplary hybrid wing rigging equipped on a multi-hull wind-propelled vessel according to embodiments of the present disclosure.

FIG. 4 illustrates an exemplary hybrid wing rigging equipped on a multi-hull wind-propelled vessel according to embodiments of the present disclosure. As shown in FIG. 4, an airfoil-shaped mast 410 may extend substantially vertically from the multi-hull wind-propelled vessel 400. As is understood in the art, the airfoil geometry provides greater lift and drive as well as an improved lift-to-drag ratio from that of traditional sails. In addition, the airfoil-shaped mast 410 may be configured to rotate in response to wind forces, most commonly, or other forces such as manual (i.e., man-powered) manipulation of the mast 410 and the like. Advantageously, that airfoil-shaped mast 410 may rotate freely during situations such as anchoring or docking of the vessel 400 without restriction from other rigging components. In other words, the airfoil-shaped mast 410 may have a 360-degree rotational range during such situations (when the sail 420 is lowered), allowing the airfoil-shaped mast 410 to automatically align with the direction of the wind, which thereby eliminates wind-induced heeling or thrust typically associated with conventional fixed wing sails, as explained in further detail hereinbelow.

A sail 420 may be movably coupled to an edge of the airfoil-shaped mast 410, such that the sail 420 can be readily hoisted or lowered along the airfoil-shaped mast 410 as desired. For instance, the sail 420 may slide upwardly and downwardly along a track 450 affixed to an edge of the airfoil-shaped mast 410 (e.g., see FIG. 5B). The sail 420 may be any conventional sail known in the art such as a curved, substantially triangular sail made of cloth, synthetic fibers (e.g., nylon, polyester, carbon fibers, aramids, etc.), or the like.

The sail 420 may be coupled to the trailing edge of the airfoil-shaped mast 410, as shown in FIG. 4. As such, no forward sail or jib (e.g., for upwind sailing) as used in most conventional wind-propelled vessels is necessary. The result is a "una-rig" arrangement whereby the rigging includes a mast combined with a single sail (without a forward sail). The "una-rig" arrangement is particularly effective in tacking back and forth against the direction of the wind, historically problematic for vessels with multiple hulls which limit the ease of turning the vessel. The "una-rig" arrangement also allows the vessel 400 to sail closer to the wind (e.g., by at least 7.5 degrees on each tack) than alternate arrangements. Nonetheless, the rigging described herein can be implemented with one or more forward sails attached to the forestay and/or set ahead of the forestay.

The airfoil-shaped mast 410 may be supported by a plurality of stays 440 connected to a swiveling masthead 430 that is coupled to a top section of the airfoil-shaped mast 410. The stays 440 may be ropes, wires, rods, or the like running from the masthead 430 to the hull(s) 405 of the vessel 400. That is, a first end of each stay 440 may be connected to the masthead 430 positioned above the mast 410, and a second (opposite) end of each stay 440 may be connected to a hull 405 of the vessel 400. The number and arrangement of the stays 440 may vary. For example, the plurality of stays 440 may include one forward stay and two aft stays (i.e., a "tripod" system), two forward stays and two aft stays (i.e., a "quadpod" system), or any other arrangement of stays suitable for supporting the airfoil-shaped mast 410.

Figure 6:
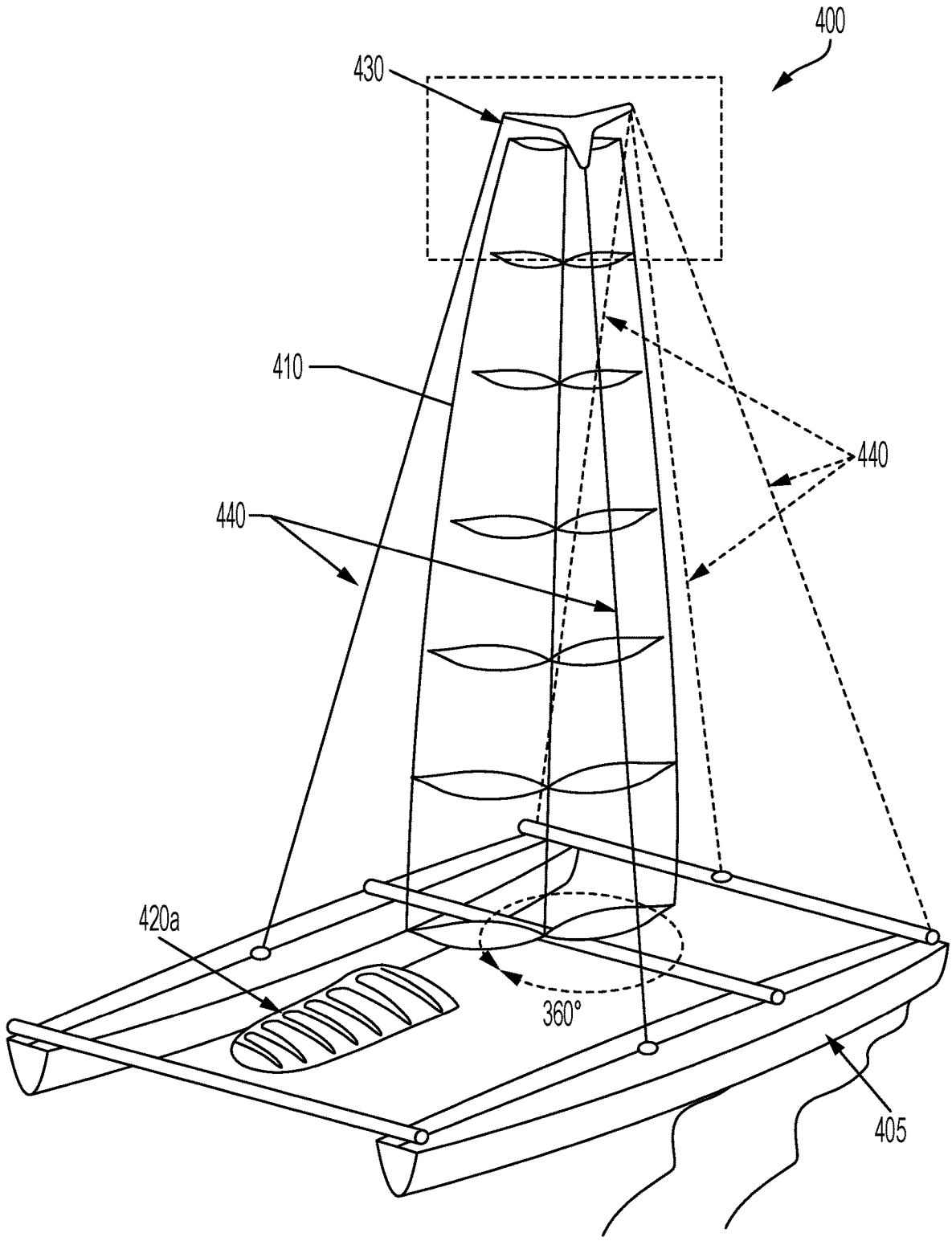
FIG. 6 illustrates the exemplary hybrid wing rigging with a fully lowered sail according to embodiments of the present disclosure.
Figure 7A:
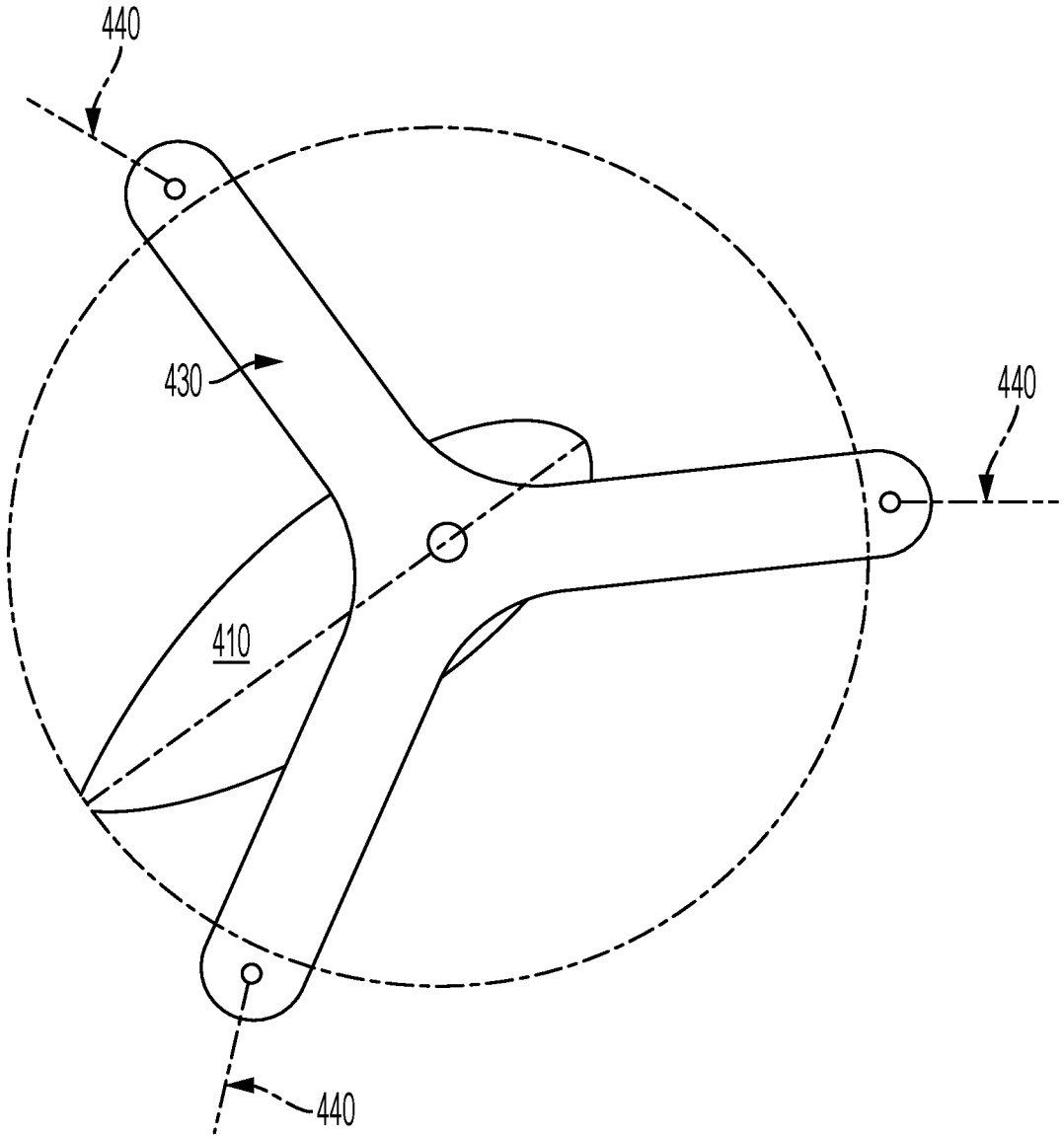
FIG. 7A illustrates a plan view of an exemplary swiveling masthead according to embodiments of the present disclosure.

The swiveling masthead 430 may include a center portion and a plurality of arms extending outwardly therefrom (e.g., see FIG. 7A). The respective first ends of the plurality of stays 440 may connect to the masthead arms and extend downwardly therefrom to the hull 405 of the vessel 400. Because the stays 440 extend from the outwardly extending arms of the masthead 430, rather than the airfoil-shaped mast 410 itself, the plurality of stays 440 may be positioned outside of a rotational range of the airfoil-shaped mast 410, such that the airfoil-shaped mast 410 is capable of rotating independent of and without interference with the plurality of stays 440. Moreover, there is no horizontal boom coupled to the sail 420; when the sail 420 is fully lowered, it is completely free of the airfoil-shaped mast 410. Therefore, when the sail 420 is lowered (e.g., see FIG. 6), the airfoil-shaped mast 410 can rotate freely and automatically align itself with a wind force exerted on the rigging, which is beneficial when the vessel 400 is at a mooring or docked but impossible with rigid, fixed wing sails found on conventional vessels.

Figure 5A:
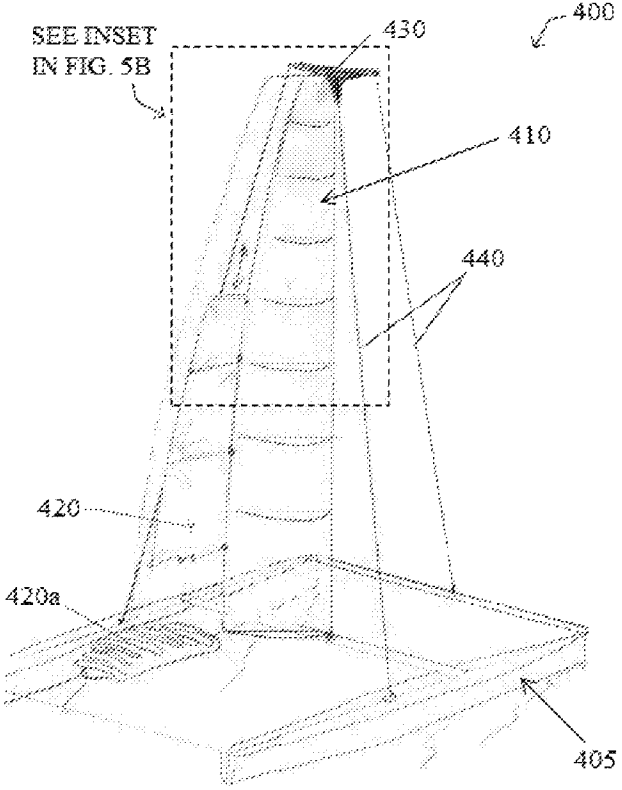
FIG. 5A illustrates the exemplary hybrid wing rigging with a partially lowered sail according to embodiments of the present disclosure.
Figure 5B:
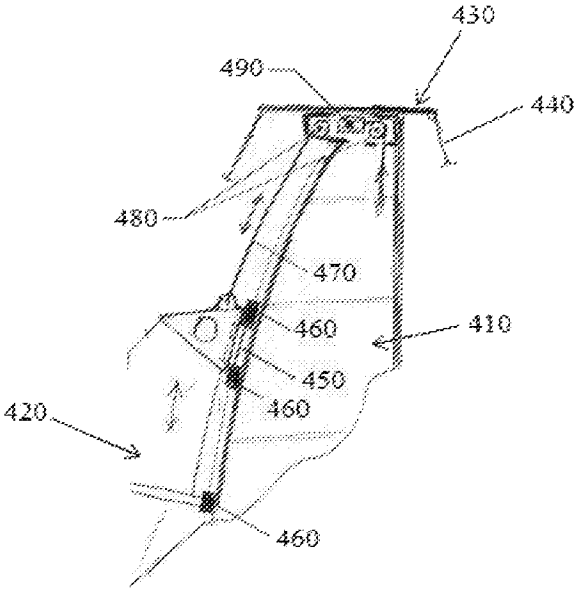
FIG. 5B illustrates an exemplary coupling system which couples the airfoil-shaped mast to the sail according to embodiments of the present disclosure.

FIG. 5A illustrates the exemplary hybrid wing rigging with a partially lowered sail according to embodiments of the present disclosure, and FIG. 5B illustrates an exemplary coupling system which couples the airfoil-shaped mast to the sail according to embodiments of the present disclosure. As shown in FIG. 5A, the sail 420 may be partially lowered, reducing the amount of drive on the vessel 400 generated by the sail 420. For example, as wind increases, the sail 420 hoisted on the airfoil-shaped mast 410 can be lowered (i.e., "reefed") to make the sail plan smaller and reduce sideways heeling and capsize loads, typically unfeasible with a rigid wing system. The portion of the sail 420 lowered onto the vessel body is represented as 420*a*.

The sail 420 may be movably attached to the airfoil-shaped mast 410 in a variety of ways. In one example, briefly described above, the sail 420 can slide upwardly and downwardly along the airfoil-shaped mast 410 on a track 450 affixed to the trailing edge of the airfoil-shaped mast 410, as shown in FIG. 5B. The sail 420 may be attached to a plurality of sliding members 460 configured to communicate with the track 450 so as to allow the sail 420 to slide upwardly and downwardly on the track 450. In some implementations, the plurality of sliding members 460 may be stowed on a separate, shorter track (not shown). The sail 420 can be hoisted or lowered by manipulating a halyard 470 which runs along one or more rolling members 480 (e.g., sheaves, pulleys, etc.) configured to accept the halyard 470 and positioned above the sail 420. In addition, a locking member 490 through which the halyard 470 runs may be configured to lock the halyard 470 so as to hold the sail 420 at specific locations (e.g., fully hoisted, various reefing points, etc.). In one example, the locking member 490 may be disposed between two rolling members 480. The one or more rolling members 480 and locking member 490 may be implemented as part of the masthead 430 or independent of the masthead 430.

FIG. 6 illustrates the exemplary hybrid wing rigging with a fully lowered sail according to embodiments of the present disclosure. As shown in FIG. 6, the sail 420 may be fully lowered (e.g., see lowered sail 420*a*), allowing the airfoil-shaped mast 410 to freely rotate. (Two different positions of the airfoil-shaped mast 410 are shown.) Here, the airfoil-shaped mast 410 can automatically align itself with a wind force of any direction, eliminating wind-induced heeling or thrust when the vessel 400 is anchored or docked (e.g., to prevent the vessel 400 from sailing unintentionally). Since the airfoil-shaped mast 410 has very little drag or thrust when aligned with the wind, the vessel 400 can be easily moored in a harbor or docked in a slip without the potentially dangerous sail loads associated with rigid wing sail systems that cannot rotate 360 degrees due to obstructing stays.

In further detail, FIG. 7A illustrates a plan view of an exemplary swiveling masthead according to embodiments of the present disclosure. As shown in FIG. 7A, the masthead 430 may include a center portion and a plurality of arms extending outwardly from the center portion. While the masthead 430 is shown in FIG. 7A as having three outwardly extending arms, additional arms may be added. As further shown in FIG. 7A, one end of each of the plurality of stays 440 may be connected to one of the outwardly extending arms, rather than being connected directly to the airfoil-shaped mast 410, thereby allowing the airfoil-shaped mast 410 to rotate independently of the plurality of stays 440.

The swiveling masthead 430 allows the airfoil-shaped mast 410 to freely rotate by extending the plurality of stays 440 which support the mast 410 outside of the mast's rotational range, as shown in FIG. 7A. As such, the airfoil-shaped mast has a rotational range of 360 degrees (when the sail 420 is lowered). In contrast to conventional stayed masts whose rotation is limited by the stays and their tangs, the plurality of stays 440 are not permanently attached to the airfoil-shaped mast 410, but rather to the swiveling masthead 430 positioned above the mast 410, enabling the airfoil-shaped mast 410 to rotate independently of the stays 440.

Figure 7B:
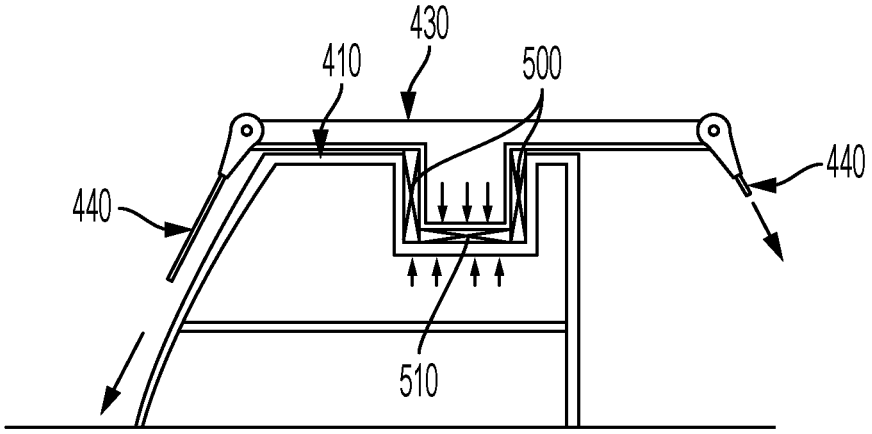
FIG. 7B illustrates an exemplary swiveling masthead fitting system according to embodiments of the present disclosure.

FIG. 7B illustrates an exemplary swiveling masthead fitting system according to embodiments of the present disclosure. As shown in FIG. 7B, the swiveling masthead 430, which is positioned substantially above the airfoil-shaped mast 410, may be equipped with one or more axial bearings 500 to facilitate rotation of the masthead 430 about a longitudinal axis of the airfoil-shaped mast 410. The one or more axial bearings 500 may enable the masthead 430 to rotate independent of the airfoil-shaped mast 410. In addition, the swiveling masthead 430 may be equipped with one or more thrust bearings 510 to sustain a downward load (e.g., a downward-directed sidestay load or headstay load) effected by a wind force exerted on the rigging. The one or more axial bearings 500 and one or more thrust bearings 510 may be any suitable type of bearings such as, for example, ball bearings, needle bearings, and the like.

Figure 8:
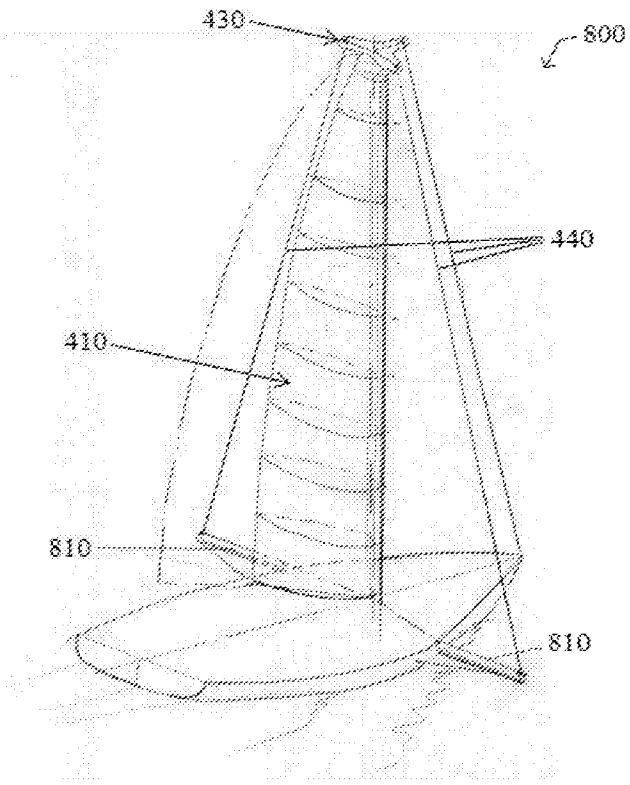
FIG. 8 illustrates an exemplary hybrid wing rigging equipped on a mono-hull wind-propelled vessel according to embodiments of the present disclosure.

FIG. 8 illustrates an exemplary hybrid wing rigging equipped on a mono-hull wind-propelled vessel according to embodiments of the present disclosure. As shown in FIG. 8, the hybrid wing rigging may also be equipped on a mono-hull vessel 800, such as off-shore racing mono-hull yachts and the like. (An outline of a hoisted sail coupled to the airfoil-shaped mast 410 is shown). In such case, the vessel 800 may be equipped with one or more sprits 810 extending outwardly from the vessel 800. One end of each of the plurality of stays 440 may be connected to one of the outwardly extending sprits 810 to allow the airfoil-shaped mast 410 to have uninhibited rotation when the sail 420 is lowered.

As described in detail above, the hybrid wing rigging described herein includes a rotating airfoil-shaped mast which benefits from the enhanced lift and drive produced by the airfoil geometry of a wing. The airfoil-shaped mast is supported by a system of stays which allows for a lighter mast. In addition, the airfoil-shaped mast is coupled to a sail which can be easily raised and lowered to readily control the propulsion of the vessel. When the sail is fully lowered, e.g., at anchor or dock, the airfoil-shaped mast has a rotational range of 360 degrees, allowing the mast to align to any wind direction, thereby eliminating wind-induced heeling or thrust of the vessel. The uninhibited rotation of the airfoil-shaped mast is made possible by a swiveling masthead, to which the system of stays is connected, that permits the stays to extend outside of the mast's rotational range.

While there have been shown and described illustrative embodiments that provide for a hybrid wing rigging for a wind-propelled vessel, it is to be understood that various other adaptations and modifications may be made within the spirit and scope of the embodiments herein. For example, it should be appreciated that the number and arrangement of stays may be adjusted according to the vessel type and the preferences of the operator, and is thus not limited by any description provided above or the figures included in this application. The present disclosure is limited only by the claims set forth herein. Therefore, the disclosed embodiments may be modified in any suitable manner in accordance with the scope of the present claims.

The foregoing description has been directed to embodiments of the present disclosure. It will be apparent, however, that other variations and modifications may be made to the described embodiments, with the attainment of some or all of their advantages. Accordingly, this description is to be taken only by way of example and not to otherwise limit the scope of the embodiments herein. Therefore, it is the object of the appended claims to cover all such variations and modifications as come within the true spirit and scope of the embodiments herein.

What is claimed is:

1. A rigging for a wind-propelled vessel, the rigging comprising:

a rotating airfoil-shaped mast;

a sail movably coupled to a trailing edge of the airfoil-shaped mast and configured to be hoisted or lowered along the airfoil-shaped mast;

a swiveling masthead coupled to a top section of the airfoil-shaped mast;

a plurality of stays supporting the airfoil-shaped mast, each stay having a first end connected to the swiveling masthead and a second end connected to a hull of the vessel; and a track affixed to the trailing edge of the airfoil-shaped mast on which the sail slides upwardly and downwardly.

2. The rigging of claim 1, wherein the plurality of stays are positioned outside of a rotational range of the airfoil-shaped mast, such that the airfoil-shaped mast is configured to rotate independent of and without interference with the plurality of stays.

3. The rigging of claim 1, wherein the rotational range of the airfoil-shaped mast is 360 degrees when the sail is lowered.

4. The rigging of claim 1, wherein the airfoil-shaped mast automatically aligns itself in accordance with a wind force exerted on the rigging when the sail is lowered.

5. The rigging of claim 1, further comprising a plurality of sliding members attached to the sail and configured to communicate with the track so as to allow the sail to slide upwardly and downwardly on the track.

6. The rigging of claim 1, further comprising one or more rolling members positioned above the sail and configured to accept a halyard which runs along the one or more rolling members for hoisting or lowering the sail along the airfoil-shaped mast.

7. The rigging of claim 6, further comprising a locking member through which the halyard runs, the locking member configured to lock the halyard so as to hold the sail in place.

8. The rigging of claim 1, wherein the swiveling masthead includes a center portion and a plurality of arms extending outwardly from the center portion, and the first end of each of the plurality of stays is connected to one of the plurality of arms.

9. The rigging of claim 1, wherein the swiveling masthead is positioned substantially above the airfoil-shaped mast.

10. The rigging of claim 1, wherein the swiveling masthead is configured to rotate independent of the airfoil-shaped mast.

11. The rigging of claim 10, wherein the swiveling masthead is configured to rotate about a longitudinal axis of the airfoil-shaped mast.

12. The rigging of claim 11, wherein the swiveling masthead is equipped with one or more axial bearings to facilitate rotation of the swiveling masthead about the longitudinal axis of the airfoil-shaped mast.

13. The rigging of claim 11, wherein the swiveling masthead is equipped with one or more thrust bearings to sustain a downward load effected by a wind force exerted on the rigging.

14. The rigging of claim 1, wherein the plurality of stays includes one forward stay and two aft stays.

15. The rigging of claim 1, wherein the plurality of stays includes two forward stays and two aft stays.

16. The rigging of claim 1, wherein the rigging lacks a forward sail.

17. The rigging of claim 1, wherein the rigging lacks a horizontal boom.

18. The rigging of claim 1, wherein the vessel is a mono-hull vessel, and the second end of one or more of the plurality of stays is connected to one or more sprits extending outwardly from the mono-hull vessel.

19. The rigging of claim 1, wherein the vessel is a multi-hull vessel.

20. A rigging for a wind-propelled vessel, the rigging comprising:

a rotating airfoil-shaped mast;

a sail movably coupled to a trailing edge of the airfoil-shaped mast and configured to be hoisted or lowered along the airfoil-shaped mast;

a swiveling masthead coupled to a top section of the airfoil-shaped mast; and a plurality of stays supporting the airfoil-shaped mast, each stay having a first end connected to the swiveling masthead and a second end connected to a hull of the vessel, wherein the rigging lacks a horizontal boom.

21. The rigging of claim 20, wherein the plurality of stays are positioned outside of a rotational range of the airfoil-shaped mast, such that the airfoil-shaped mast is configured to rotate independent of and without interference with the plurality of stays.

22. The rigging of claim 20, wherein the rotational range of the airfoil-shaped mast is 360 degrees when the sail is lowered.

23. The rigging of claim 20, wherein the airfoil-shaped mast automatically aligns itself in accordance with a wind force exerted on the rigging when the sail is lowered.

24. The rigging of claim 20, further comprising a track affixed to the trailing edge of the airfoil-shaped mast on which the sail slides upwardly and downwardly.

25. The rigging of claim 24, further comprising a plurality of sliding members attached to the sail and configured to communicate with the track so as to allow the sail to slide upwardly and downwardly on the track.

26. The rigging of claim 20, further comprising one or more rolling members positioned above the sail and configured to accept a halyard which runs along the one or more rolling members for hoisting or lowering the sail along the airfoil-shaped mast.

27. The rigging of claim 26, further comprising a locking member through which the halyard runs, the locking member configured to lock the halyard so as to hold the sail in place.

28. The rigging of claim 20, wherein the swiveling masthead includes a center portion and a plurality of arms extending outwardly from the center portion, and the first end of each of the plurality of stays is connected to one of the plurality of arms.

29. The rigging of claim 20, wherein the swiveling masthead is positioned substantially above the airfoil-shaped mast.

30. The rigging of claim 20, wherein the swiveling masthead is configured to rotate independent of the airfoil-shaped mast.

31. The rigging of claim 30, wherein the swiveling masthead is configured to rotate about a longitudinal axis of the airfoil-shaped mast.

32. The rigging of claim 31, wherein the swiveling masthead is equipped with one or more axial bearings to facilitate rotation of the swiveling masthead about the longitudinal axis of the airfoil-shaped mast.

33. The rigging of claim 31, wherein the swiveling masthead is equipped with one or more thrust bearings to sustain a downward load effected by a wind force exerted on the rigging.

34. The rigging of claim 20, wherein the plurality of stays includes one forward stay and two aft stays.

35. The rigging of claim 20, wherein the plurality of stays includes two forward stays and two aft stays.

36. The rigging of claim 20, wherein the rigging lacks a forward sail.

37. The rigging of claim 20, wherein the vessel is a mono-hull vessel, and the second end of one or more of the plurality of stays is connected to one or more sprits extending outwardly from the mono-hull vessel.

38. The rigging of claim 20, wherein the vessel is a multi-hull vessel.

* * * * *